US005765799A

United States Patent [19]

Weber

[11] Patent Number: 5,765,799

[45] Date of Patent: Jun. 16, 1998

[54] PORTABLE COLLAPSIBLE STAND FOR FACILITATING HOLDING BOOK PAGES OPEN

[76] Inventor: Barbara Weber, 2237 Casitas Way, Palm Springs, Calif. 92264

[21] Appl. No.: 762,932

[22] Filed: Dec. 10, 1996

[51] Int. Cl.[6] ..... A47B 97/04

[52] U.S. Cl. ..... 248/453; 248/455; 248/460

[58] Field of Search ..... 248/453, 455, 248/460, 446, 441.1, 444.1, 447

[56] References Cited

U.S. PATENT DOCUMENTS

| | | | |
|---|---|---|---|
| 1,197,233 | 9/1916 | Plamondon et al. | 248/453 |
| 1,220,705 | 3/1917 | Tayte | 248/453 |
| 2,136,701 | 11/1938 | Mainerre | 248/453 X |
| 2,374,409 | 4/1945 | Brennan | 248/453 |
| 2,595,682 | 5/1952 | Lipa | 248/453 |
| 2,609,636 | 9/1952 | Stone | 248/453 |
| 4,886,231 | 12/1989 | Doerksen | 248/453 X |

*Primary Examiner*—Ramon O. Ramirez
*Attorney, Agent, or Firm*—Rines and Rines

[57] ABSTRACT

A novel portable collapsible stand for facilitating holding the pages of an open book for reading and having a lower resting sheet hinged at its bottom edge to an upper book-supporting sheet having a lower edge provided with a ledge upon which the bottom edges of the opened book pages may rest and are automatically restrained from turning or movement by a page-restraining surface resiliently pressed thereagainst by a resilient hinge between the outer edge of the ledge and the bottom edge of the page-restraining surface.

7 Claims, 1 Drawing Sheet

PORTABLE COLLAPSIBLE STAND FOR FACILITATING HOLDING BOOK PAGES OPEN

The present invention relates to apparatus for holding books open to permit reading without use of the hands; being more particularly directed to providing an automatically adjusting open page restraining feature that, once a page is turned, prevents movement of the opened pages until the reader purposefully turns the page, whereupon automatic restraint of movement of the newly turned page(s) enables continued uninterrupted reading.

BACKGROUND

The art is replete with book stands of many different designs. Few, however, have the facility for portability, as in a coat pocket or pocketbook or the like; and, until the advent of the present invention, there has been no satisfactory simple, portable and automatic restraint against open pages inadvertently turning, or for enabling use with a wide range of acceptability of books of varying thicknesses that may readily be read with a minimum of handling by the reader and with security against page movement or flapping.

OBJECTS OF INVENTION

The principal object of the present invention, accordingly, is to provide a new and improved book stand that has novel features of collapsibility and portability, and that is not subject to the above described and other limitations of prior art stands, but, to the contrary, provides a simple, inexpensive and highly effective book-reading stand with novel automatic and user-friendly operative restraint against undesired open page turning, flipping, or movement, as in windy environments or the like.

A further object is to provide a novel reading stand of more general applicability, also.

Other and further objects will be explained hereinafter and are more particularly delineated in the appended claims.

SUMMARY

In summary, however, from one of its important aspects, the invention embraces a portable collapsible stand and apparatus for facilitating holding open the pages contained between the covers of a book, having, in combination, a table resting surface and a book cover supporting surface having adjacent inner edges hingedly connected together for collapsing to a juxtaposed position for carrying or storage, and for opening to a reading position wherein means is disposed between the surfaces to support the book cover supporting surface at an inclined angle to the table-resting surface; a book page bottom edge resting ledge extending outward from said inner edge of the book cover supporting surface and provided along its outer edge with a resiliently hinged page-restraining surface inclining inwardly from such outer edge toward the book cover resting surface, resiliently automatically to restrain the open pages from turning or movement during their reading and during page changing.

Preferred and best mode design features are hereinafter presented.

DRAWINGS

The invention will now be described with reference to the accompanying drawings, FIG. 1 of which is a side elevation of a preferred form of the invention, shown in collapsed and portable position; and FIG. 2 is an isometric view of the apparatus, shown made from transparent plastic sheeting (a very attractive form, though colored, translucent and opaque materials may also be used, as desired) which also makes apparent the constructional features.

DESCRIPTION OF PREFERRED EMBODIMENT OF INVENTION

Figure 1:
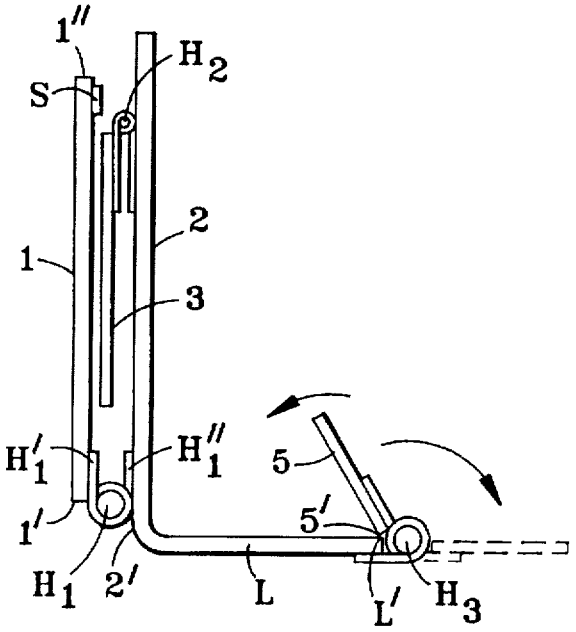
Figure 2:
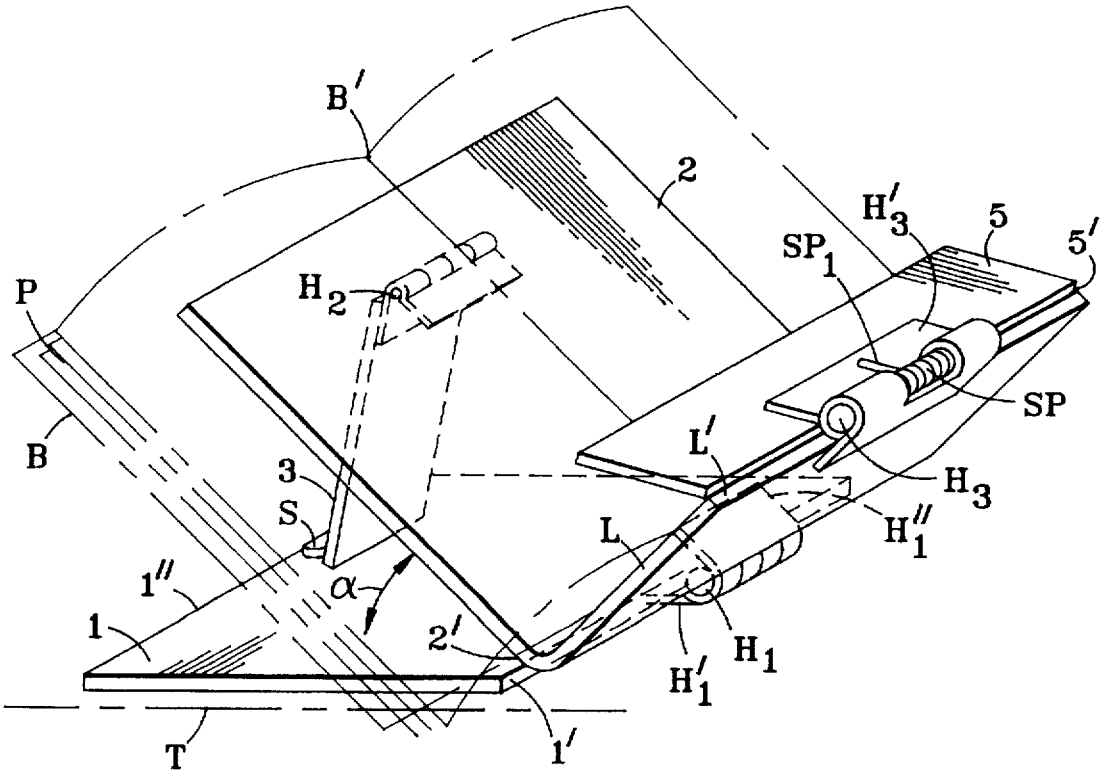

Referring to FIGS. 1 and 2, the book stand of the invention comprises a pair of thin, preferably light weight planar sheets 1 and 2, serving respectively, as resting surfaces, as for laying on the table T, FIG. 2, and for receiving and supporting a hook B, the open pages P of which within the outer covers and on either side of the central binding $B^1$ are to be read by the reader—in accordance with the present invention, with minimal necessity for handling or adjustments and totally independently of environmental wind, fans, air conditioning, vehicle or other vibration or movements that customarily require adjustment of pages and/or cause their inadvertent turning and reading place loss.

The invention is even more particularly important for readers who must perform activities with their hands and cannot be concerned with restraining inadvertent page movement or turning, and who must be sure that once turned, the page(s) is absolutely secured and without danger of movement; and those also who require rapid page turning with positive assurance of instant page fixing, once turned, (musicians, cooks, prompters, operators of equipment, etc.). Disabled persons, furthermore, are provided, under the invention, with a most simple page securing device that is operated by minimal strength finger action but with automatic positive page holding—and with accommodation for a wide range of book page thicknesses. For the ordinary paper-back or pocket-book traveler, diner, commuter, reader, the invention not only provides the above features, but in a small, compact, portable device that can easily be slipped into a coat pocket or handbag or carried luggage.

Indeed, prototypes as shown in FIGS. 1 and 2, have been made extremely lightweight, as of "Lexan" sheet plastic material (or polystyrene or polyvinyl or other similar plastic materials, or thin metal or even wood and the like); and of dimensions about six inches by four inches or less, and an inch and a half at their widest lower region.

In the collapsed or carrying position of FIG. 1, the resting sheet 1 is shown parallely stored adjacent the book supporting sheet 2 by virtue of closing the hinge $H_1$ (preferably also of the well-known plastic interlocking cylinder type with hinge plates $H_1'$ and $H_1''$ shown at the rear surface of the sheet 2 and the front surface of the sheet 1 at their respective bottom edges 1' and 2', FIG. 1 (their inner adjacent "bottom" edges 1' and 2' in the open position of FIG. 2). In the open or use-operative position of FIG. 2, the book-supporting sheet 2 is in an upper position and the resting sheet 1 is in a lower position resting, for example, on the table T, as before described.

To maintain the upper book-supporting sheet 2 in an appropriate reading position, it is shown held at an acute angle (preferably about 45°) to the lower resting sheet 1 by a leg support 3 hinged at its upper end intermediately to the rear surface of the upper sheet 2 at $H_2$ so as to open from the collapsed storage and carrying position of FIG. 1, parallely between the sheets 1 and 2, to the inclined open position of FIG. 2, being restrained by a stop S, preferably near the top edge 1" of the sheet 1 in FIG. I (shown at the outer "Top" edge 1" in FIG. 2).

The upper position sheet 2 (FIG. 2) is shown somewhat longer than the resting sheet 1, not only to accommodate the support of a variety of sizes of books B, but to enable the provision of a book page supporting ledge L, preferably integral with the sheet 2 at its lower edge 2', and extending outwardly at substantially right angles (orthogonally) thereto. As shown in dotted lines, the bottom edges of the open pages P of the book B rest, in part, on the ledge L. Against the lower front portions of the pages, at least in the regions where they start to diverge from the binding $B^1$, they are contacted by a page-restraining preferably planar surface 5, generally near its outer top corners, which, through the resilient action of, for example, a spring controlled hinge $H_3$ between intermediate adjacent regions of the lower edge 5' of the surface 5 and the outer edge L' of the ledge L, causes the surface 5 automatically inclinedly and resiliently to restrain the open pages P on each side of the binding $B^1$.

As more particularly shown in the collapsed position of FIG. 1, the inner corner of the bottom edge 5' of the restraining surface 5 is forced by the resilient hinge into contact with the outer edge L' of the ledge L as the innermost angle β of incline of the surface 5 to the ledge L. For accommodating wide variations in page sizes and book page thicknesses, it has been found that not only should the width of the book-support sheet 2 and of the ledge L be the same, but so also should the width of the page-restraining sheet on surface 5. In the above-referenced prototype units, this width was about four inches, with the surface 5 being about an inch and a quarter tall, and the initial innermost included angle β, about 60° to 70°.

As the thickness of pages on one side or the other of the book binding B' increases in response to the reader turning the pages, the reader, with minimal finger movement, lifts back the surface 5, against the spring action; and, after page turning, releases the surface 5 which automatically snaps back or re-applies resilient page-restraining contact against the pages, holding them positively and reliably fixed from movement from any external causes.

Books with large numbers of pages can thus be automatically accommodated, the limit of the resilient hinge $H_3$ being substantially β=180°, with the surface 5 substantially coplanar with the ledge L, as shown in dotted lines in FIG. 1.

As for the resilient hinge $H_3$, as more particularly shown in FIG. 2, it is shown comprising the same type of well-known external cylindrical plastic hinge barrel and hinge plates $H_3'$ and $H_3''$ but with an intermediate spring SP, the free ends of which resiliently bear against the hinge plates (end $SP_1$ shown in FIG. 2, bearing against plate $H_3^1$, and the other end, not shown, bearing against plate $H_3''$).

Clearly, other types of hinges, including those made integral with the various preferred plastic parts may be used as may other shapes of support legs or restraining surfaces. Further modifications will also occur to others skilled in this art and all such are considered to fall within the spirit and scope of the invention as defined in the appended claims.

What is claimed is:

1. A portable collapsible stand apparatus for facilitating holding open the pages contained by a book binding between the covers of an opened book, having, in combination, a pair of planar lower and upper sheets each provided with front and rear surfaces and with top and bottom edges, the bottom edges of which are hingedly connected to permit the surfaces to occupy a carrying position wherein they are hingedly foldable into a substantially parallel closed position relationship with the front surface of the lower sheet facing the rear surface of the upper sheet, and into an open position with an included angle therebetween and with the rear surface of the lower sheet adapted for resting on a resting surface; the rear surface of the upper sheet being provided with a leg member having top and bottom ends and the top end of which is hingedly connected to an intermediate region of the rear surface of the upper sheet to occupy a retracted position between the front surface of the lower sheet and the rear surface of the upper sheet in said closed position and to rest with its bottom against the front surface of the lower sheet to hold the sheets in said open position; the front of the lower sheet being provided with a stop against which the bottom end of the leg member may engage to hold the sheets fixed in said open position; a ledge provided to extend from an inner edge outward from the bottom edge of the upper sheet to an outer edge to receive a book resting under the influence of gravity with its covers against the front surface of the upper sheet and the bottom edges of the opened book pages on each side of the binding resting at least in part on the ledge; and the outer edge of the ledge being provided with a page-restraining surface extending from the outer edge of the ledge hingedly incliningly inwardly toward the front surface of the upper sheet to contact the open pages on each side of the book binding and restrain the same from turning; and resilient means provided for locking the page-restraining surface at successively decreasing inclined angles with the ledge to accommodate for different thicknesses of numbers of pages of the opened book on each side of the binding as the reader reads the book and turns the pages, resiliently pulling outward on the page-restraining surface to effect a page turn and then resiliently releasing the page-restraining surface to again contact and automatically restrain the book pages against turning or movement, and in which said stop is positioned to hold the upper sheet at an acute angle to the lower sheet for comfortable reading of the book as the lower sheet rests on a resting surface, and in which the upper sheet is somewhat longer than the lower sheet, with the ledge positioned below the hinged connection of the bottom edges of the upper and lower sheets and extending at substantially right angles to the upper sheet.

2. Apparatus as claimed in claim 1 and in which the stop is positioned sufficiently near the top edge of the lower sheet to enable the leg member to position the upper sheet at an angle of about 45° to the lower sheet in the open position.

3. Apparatus as claimed in claim 1 and in which the upper sheet, the ledge and the page-restraining surface are all of substantially the same width.

4. Apparatus as claimed in claim 1 and in which the page-restraining surface is intermediately resiliently hinged to said outer edge of the ledge and restrained normally to make contact therewith, with the page-restraining surface defining an acute angle with the ledge.

5. Apparatus as claimed in claim 4 and in which the hinge between the page-restraining surface and the ledge is provided with hinge plates respectively adjacent the bottom of the ledge and the adjacent outer side of the page-restraining surface with interlocking relatively rotatable hinge bearings therealong, and intermediately provided with a spring the ends of which bear against the respective hinge plates.

6. Apparatus as claimed in claim 5 and in which the page-restraining surface is resiliently liftable from a forward position at an angle of about 60° to 70° with respect to the ledge to a fully open position substantially co-planar therewith.

7. Apparatus as claimed in claim 4 and in which the page-restraining surface hinge is disposed intermediate the ledge and permits lifting adjustment of the page-restraining surface from a forward position at an angle of about 60°–70° with respect to the ledge to a fully open position substantially co-planar therewith.

* * * * *